US011453229B2

(12) United States Patent
Aoki

(10) Patent No.: US 11,453,229 B2
(45) Date of Patent: Sep. 27, 2022

(54) RECORDING APPARATUS

(71) Applicant: SEIKO EPSON CORPORATION, Tokyo (JP)

(72) Inventor: Takeshi Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 357 days.

(21) Appl. No.: 16/752,029

(22) Filed: Jan. 24, 2020

(65) Prior Publication Data

US 2020/0238741 A1 Jul. 30, 2020

(30) Foreign Application Priority Data

Jan. 25, 2019 (JP) ..... JP2019-010963

(51) Int. Cl.
*B65H 7/02* (2006.01)
*B41J 29/13* (2006.01)
*B65H 29/58* (2006.01)

(52) U.S. Cl.
CPC ..... *B41J 29/13* (2013.01); *B65H 7/02* (2013.01); *B65H 29/58* (2013.01); *B65H 2402/441* (2013.01); *B65H 2402/45* (2013.01); *B65H 2511/417* (2013.01); *B65H 2601/11* (2013.01)

(58) Field of Classification Search
CPC ..... B65H 2402/441; B65H 2601/11; B65H 2402/45; B65H 2402/10; B65H 2402/324; B65H 2404/152; B65H 2404/1522; B65H 2404/1521
See application file for complete search history.

(56) References Cited

U.S. PATENT DOCUMENTS 8,998,205 B2 * 4/2015 Nakahata ..... B65H 5/068 347/108
9,085,433 B2 * 7/2015 Aoki ..... B41J 11/006
9,114,943 B2 * 8/2015 Aoki ..... B65H 7/02
2015/0061216 A1 3/2015 Aoki et al.
2015/0307307 A1 10/2015 Goto et al.

FOREIGN PATENT DOCUMENTS

JP 2015-049413 3/2015
JP 2015-215588 12/2015

* cited by examiner

*Primary Examiner* — Jeremy R Severson
(74) *Attorney, Agent, or Firm* — Workman Nydegger

(57) ABSTRACT

A recording apparatus includes: an apparatus body that includes a recorder that performs recording on a medium; an opening-and-closing member that is able to be opened away from and closed toward the apparatus body; a unit module that is detachably attached to an attachment portion configured to become exposed by opening the opening-and-closing member, and constitutes a part of a first medium transportation path when attached to the attachment portion; a second medium transportation path that is provided above the first medium transportation path; and a path forming member that is located above the attachment portion and forms a part of the second medium transportation path; wherein the path forming member is retracted from the second medium transportation path and advances onto the opening-and-closing trajectory of the opening-and-closing member when the unit module is detached from the attachment portion.

9 Claims, 16 Drawing Sheets

RECORDING APPARATUS

The present application is based on, and claims priority from JP Application Serial Number 2019-010963, filed Jan. 25, 2019, the disclosure of which is hereby incorporated by reference herein in its entirety.

BACKGROUND

1. Technical Field

Embodiments of the present disclosure relate to a recording apparatus, typical examples of which include a facsimile and a printer.

2. Related Art

Among recording apparatuses such as facsimiles and printers, some apparatuses have the following structure. The apparatus includes a detachable unit module provided inside its body. The unit module is attached or detached after opening an opening-and-closing member. Examples of the unit module are an image transfer unit, a roller unit that includes rollers constituting a sheet transportation path, and the like. There is a risk of various problems occurring if a recording apparatus that has such a structure performs recording operation when a unit module is not attached to the inside of the body of the apparatus. An example of the problems is a sheet jam.

As an example of a technique for preventing such a problem, an image forming apparatus disclosed in JP-A-2015-215588 includes an intermediate image transfer unit provided detachably at the inside of an opening-and-closing member called as right door, and further includes an interference mechanism provided on the inside of the opening-and-closing member. The interference mechanism includes a moving member that changes its position depending on whether the intermediate image transfer unit is attached or not. The moving member prevents the opening-and-closing member from becoming closed completely when the intermediate image transfer unit is not attached. If a sensor detects that the opening-and-closing member is not closed completely, image forming operation is disabled.

In the image forming apparatus disclosed in JP-A-2015-215588, the interference mechanism, which has a function of preventing the opening-and-closing member from becoming closed completely when the intermediate image transfer unit is not attached, is a dedicated device provided exclusively for this purpose. Such a dedicated device increases cost.

SUMMARY

A recording apparatus according to a certain aspect of the present disclosure includes an apparatus body that includes a recorder that performs recording on a medium; an opening-and-closing member that is able to be opened away from and closed toward the apparatus body; an attachment portion that is provided in the apparatus body and becomes exposed by opening the opening-and-closing member; a unit module that is detachably attached to the attachment portion and constitutes a part of a first medium transportation path when attached to the attachment portion; a second medium transportation path that is provided above the first medium transportation path; and a path forming member that is located above the attachment portion and forms a part of the second medium transportation path; wherein the path forming member is able to change in positional state, the path forming member forms a part of the second medium transportation path and is put in first position of being retracted from an opening-and-closing trajectory of the opening-and-closing member when the unit module is attached to the attachment portion, and the path forming member is put in second position of being retracted from the second medium transportation path and advancing onto the opening-and-closing trajectory of the opening-and-closing member when the unit module is detached from the attachment portion.

DESCRIPTION OF EXEMPLARY EMBODIMENTS

Figure 1:
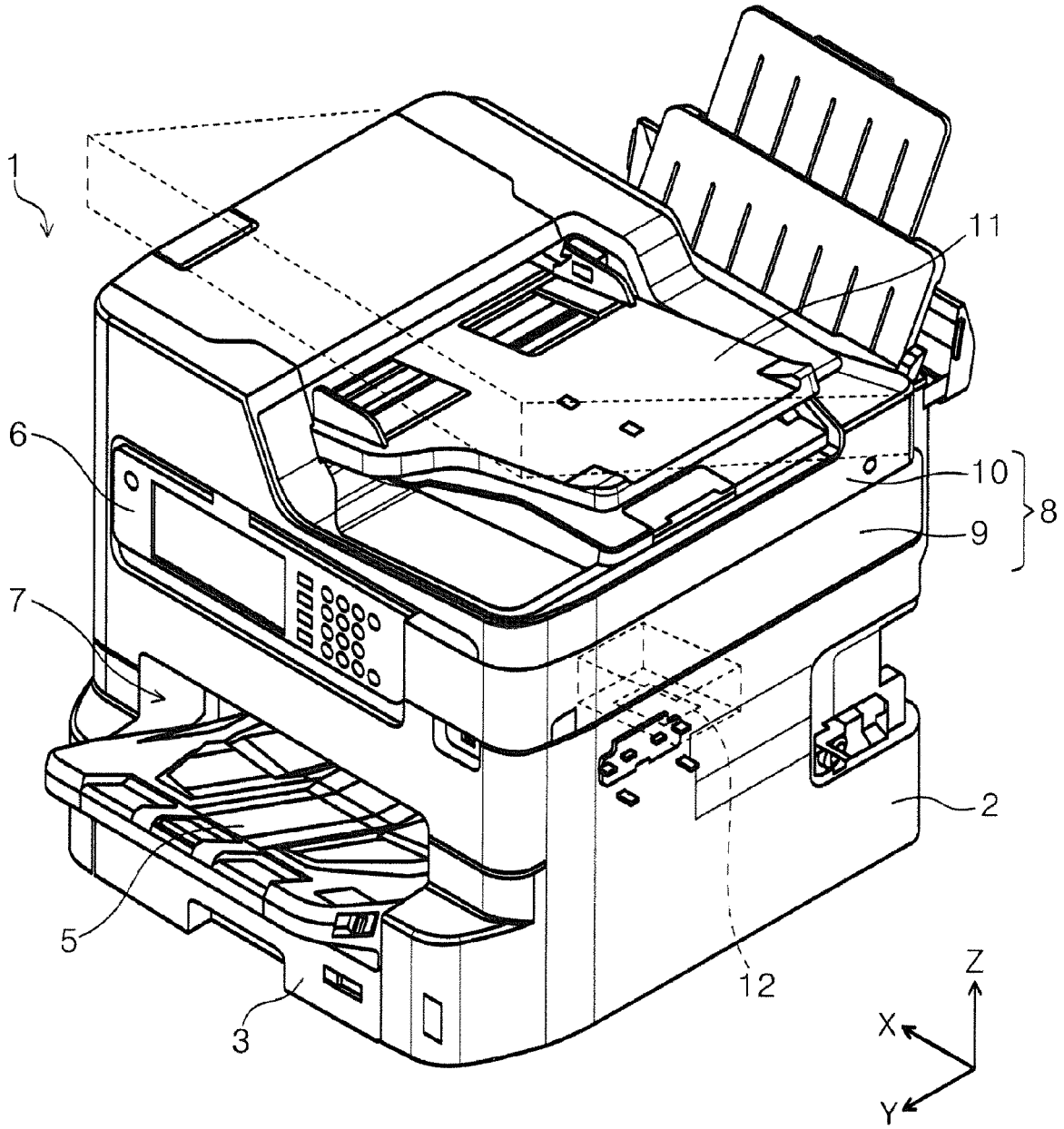
FIG. 1 is a front perspective view of a multifunction peripheral.

Description for presenting an overview of some aspects of the present disclosure is given below.

A recording apparatus according to a first aspect of the present disclosure includes an apparatus body that includes a recorder that performs recording on a medium; an opening-and-closing member that is able to be opened away from and closed toward the apparatus body; an attachment portion that is provided in the apparatus body and becomes exposed by opening the opening-and-closing member; a unit module that is detachably attached to the attachment portion and constitutes a part of a first medium transportation path when attached to the attachment portion; a second medium transportation path that is provided above the first medium transportation path; and a path forming member that is located above the attachment portion and forms a part of the second medium transportation path; wherein the path forming member is able to change in positional state, the path forming member forms a part of the second medium transportation path and is put in first position of being retracted from an opening-and-closing trajectory of the opening-and-closing member when the unit module is attached to the attachment portion, and the path forming member is put in second position of being retracted from the second medium transportation path and advancing onto the opening-and-closing trajectory of the opening-and-closing member when the unit module is detached from the attachment portion.

In this aspect, the path forming member configured to form the second medium transportation path is utilized for preventing the opening-and-closing member from being closed completely when the apparatus is in a state of detachment of the unit module. This structure reduces the number of parts required for preventing the opening-and-closing member from being closed completely and therefore prevents an increase in the cost of the apparatus.

A second aspect is that, in a structure of the first aspect, the path forming member that is in the second position is switched to the first position from the second position by being pushed up by the unit module when the unit module is attached to the attachment portion, and the path forming member that is in the first position is switched to the second position from the first position by losing positional support by the unit module when the unit module is detached from the attachment portion.

In this aspect, since the positional state of the path forming member switches due to attachment and detachment of the unit module, the structure of the positional switcher of the path forming member is simplified, thereby reducing cost.

A third aspect is that, in a structure of the second aspect, the unit module includes a pushing-up portion for pushing up the path forming member, and the pushing-up portion has a sloped surface, and an amount of pushing up the path forming member increases as the unit module is moved in an attachment direction.

In this aspect, the unit module includes a pushing-up portion for pushing up the path forming member, and the pushing-up portion has a sloped surface, and an amount of pushing up the path forming member increases as the unit module is moved in an attachment direction. Because of this structure, a sense of resistance that a user will feel during the attachment of the unit module is minimized.

A fourth aspect is that, in a structure of the second aspect, the path forming member is kept in the first position by being supported by the unit module attached to the attachment portion.

In this aspect, since the path forming member is kept in the first position by being supported by the unit module, it is possible to keep the path forming member in the first position reliably.

A fifth aspect is that, in a structure of the fourth aspect, the path forming member includes an elastic member at a position facing the unit module, and the path forming member is pushed in a direction of being held in the first position due to an elastic force of the elastic member acting between the unit module and the path forming member in the first position.

In this aspect, the path forming member includes an elastic member at a position facing the unit module, and the path forming member is pushed in a direction of being held in the first position due to an elastic force of the elastic member acting between the unit module and the path forming member in the first position. This further ensures that the path forming member is kept in the first position.

A sixth aspect is that, in a structure of the first aspect, the path forming member is able to change from the second position to third position that is further away from the second medium transportation path.

In this aspect, since the path forming member is able to change from the second position to the third position that is further away from the second medium transportation path, it is possible to open the second medium transportation path more widely. When a sheet jam has occurred on the second medium transportation path, this makes it easier to troubleshoot the jam.

A seventh aspect is that, in a structure of the first aspect, the second medium transportation path includes a first roller that transports the medium and a second roller that nips the medium with the first roller therebetween, the path forming member supports the second roller, the first roller and the second roller are able to nip the medium therebetween when the path forming member is in the first position, and the second roller is separated away from the first roller by positional switching of the path forming member from the first position to the second position.

In this aspect, the path forming member supports the second roller, and the second roller is separated away from the first roller when the path forming member switches from the first position to the second position. Therefore, the nipping of the sheet between the first roller and the second roller is released, making it easier to troubleshoot a sheet jam that has occurred on the second medium transportation path.

An eighth aspect is that, in a structure of the first aspect, the path forming member changes in positional state by pivoting around a pivot shaft, and, when the path forming member that is in a state of advancing onto the opening-and-closing trajectory of the opening-and-closing member receives a pushing force from the opening-and-closing member attempted to be closed, the pushing force, which the path forming member receives at its region of contact with the opening-and-closing member, acts toward the pivot shaft.

In this aspect, when the path forming member that is in the second position receives a pushing force from the opening-and-closing member attempted to be closed, the pushing force, which the path forming member receives at its region of contact with the opening-and-closing member, acts toward the pivot shaft. Therefore, it is possible to avoid a problem of unwanted positional switching of the path forming member from occurring due to the pushing force received from the opening-and-closing member attempted to be closed.

A ninth aspect is that, in a structure of the first aspect, the apparatus body includes a sensor that detects complete closing of the opening-and-closing member, and a region where the opening-and-closing member comes into contact when the opening-and-closing member is closed onto the path forming member that is in the second position is on a same side as the sensor in a width direction intersecting with a direction of attachment and detachment of the unit module.

In this aspect, the apparatus body includes a sensor that detects complete closing of the opening-and-closing member, and a region where the opening-and-closing member comes into contact when the opening-and-closing member is closed onto the path forming member that is in the second position is on a same side as the sensor in a width direction intersecting with a direction of attachment and detachment of the unit module. Therefore, it is possible to detect the complete closing of the opening-and-closing member reliably.

Embodiments of the present disclosure will now be explained with specific examples. In the accompanying drawings, the direction along the X axis is defined as a width direction of an apparatus. In the following description, the direction along the X axis may be referred to as "X-axis direction" when no distinction is made between a +X direction and a −X direction. The direction along the Y axis is defined as a depth direction of the apparatus. The direction from the rear toward the front of the apparatus is a +Y direction. The direction from the front toward the rear of the apparatus is a −Y direction. In the following description, the direction along the Y axis may be referred to as "Y-axis direction" when no distinction is made between a +Y direction and a −Y direction. The direction along the Z axis is defined as a vertical direction. The direction going perpendicularly upward is a +Z direction. The direction going perpendicularly downward is a −Z direction. In the following description, the direction along the Z axis may be referred to as "Z-axis direction" when no distinction is made between a +Z direction and a −Z direction. In the present embodiment, among lateral faces constituting the lateral enclosure of the apparatus, a lateral face on which an operation unit 6 is provided is explained as the front of the apparatus.

With reference to, mainly, FIG. 1, the overall structure of a multifunction peripheral 1 will now be explained. The multifunction peripheral 1 is an example of a recording apparatus. The multifunction peripheral 1 illustrated in FIG. 1 includes a recording unit 2 and a scanner unit 8 and has a print function and an image read function. The recording unit 2 is the body portion of the multifunction peripheral 1. The scanner unit 8 is provided over the recording unit 2.

As illustrated in FIG. 1, an operation unit 6 is provided on the upper front portion of the multifunction peripheral 1. The operation unit 6 includes a display such as a liquid crystal panel. By operating the operation unit 6, a user is able to instruct the multifunction peripheral 1 to perform print operation by the recording unit 2 or image read operation by the scanner unit 8.

In the multifunction peripheral 1, a sheet container cassette 3, which contains sheets of recording paper, is provided under the recording unit 2. A recording head 12, which is an example of a recorder, is provided inside the recording unit 2. The recording head 12 performs recording on each sheet of recording paper transported from the sheet container cassette 3. After the recording, the recorded sheet is ejected through an ejection port 7. Ejected sheets are stacked on an ejection tray 5.

The scanner unit 8 includes a scanner body 9, which scans a document, and an automatic document feeder 10, which automatically feeds a document placed on a feeder tray 11 for scanning. The automatic document feeder 10 is provided over the scanner body 9 and allows its positional state to be switched between a closed state, which is indicated by solid-line illustration in FIG. 1, and an open state, which is indicated by dotted-line illustration in FIG. 1. A document table (not illustrated), on which a user places a document, appears when the user opens the automatic document feeder 10.

Figure 2:
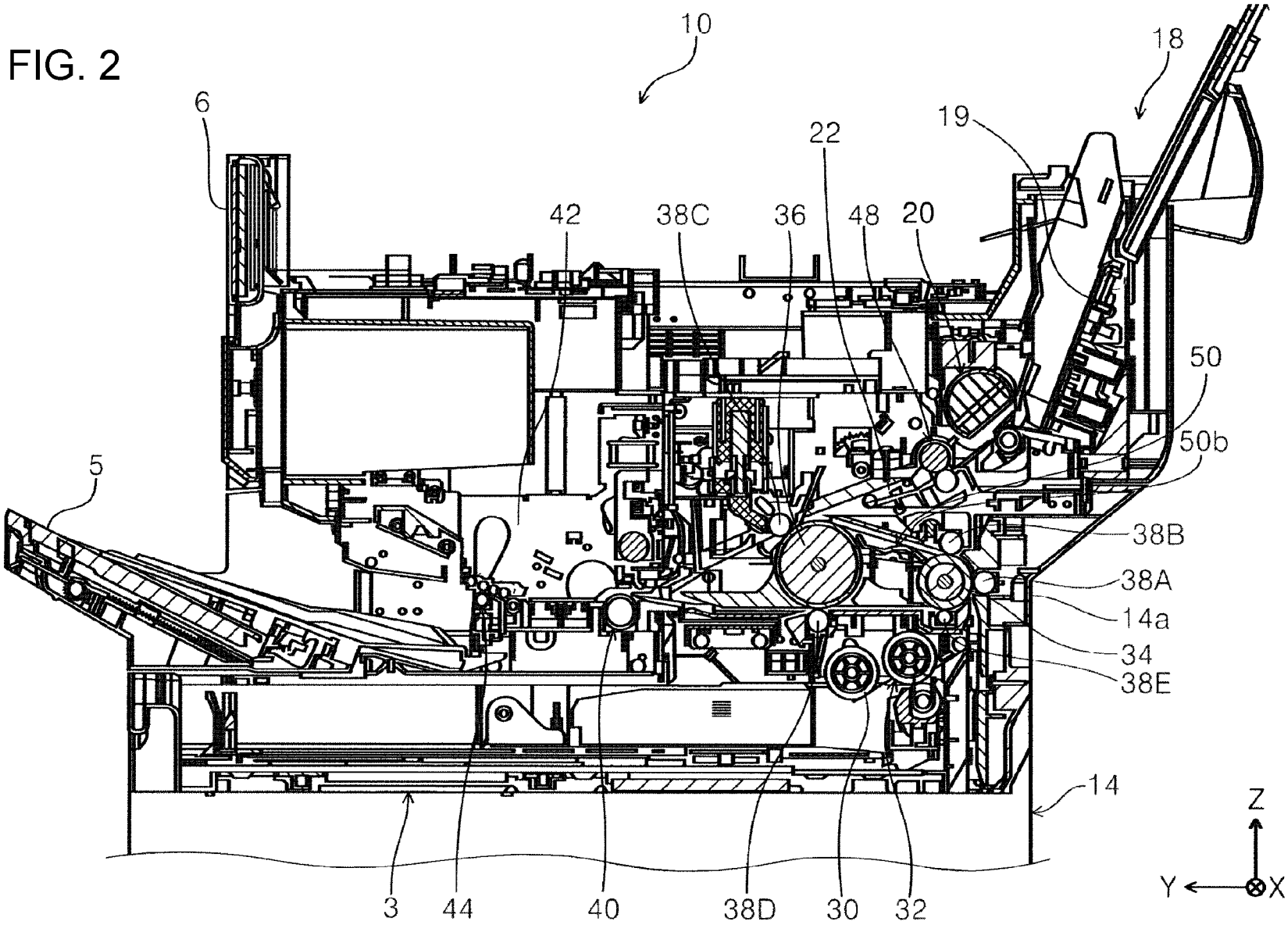
FIG. 2 is a side sectional view of a recording unit.
Figure 3:
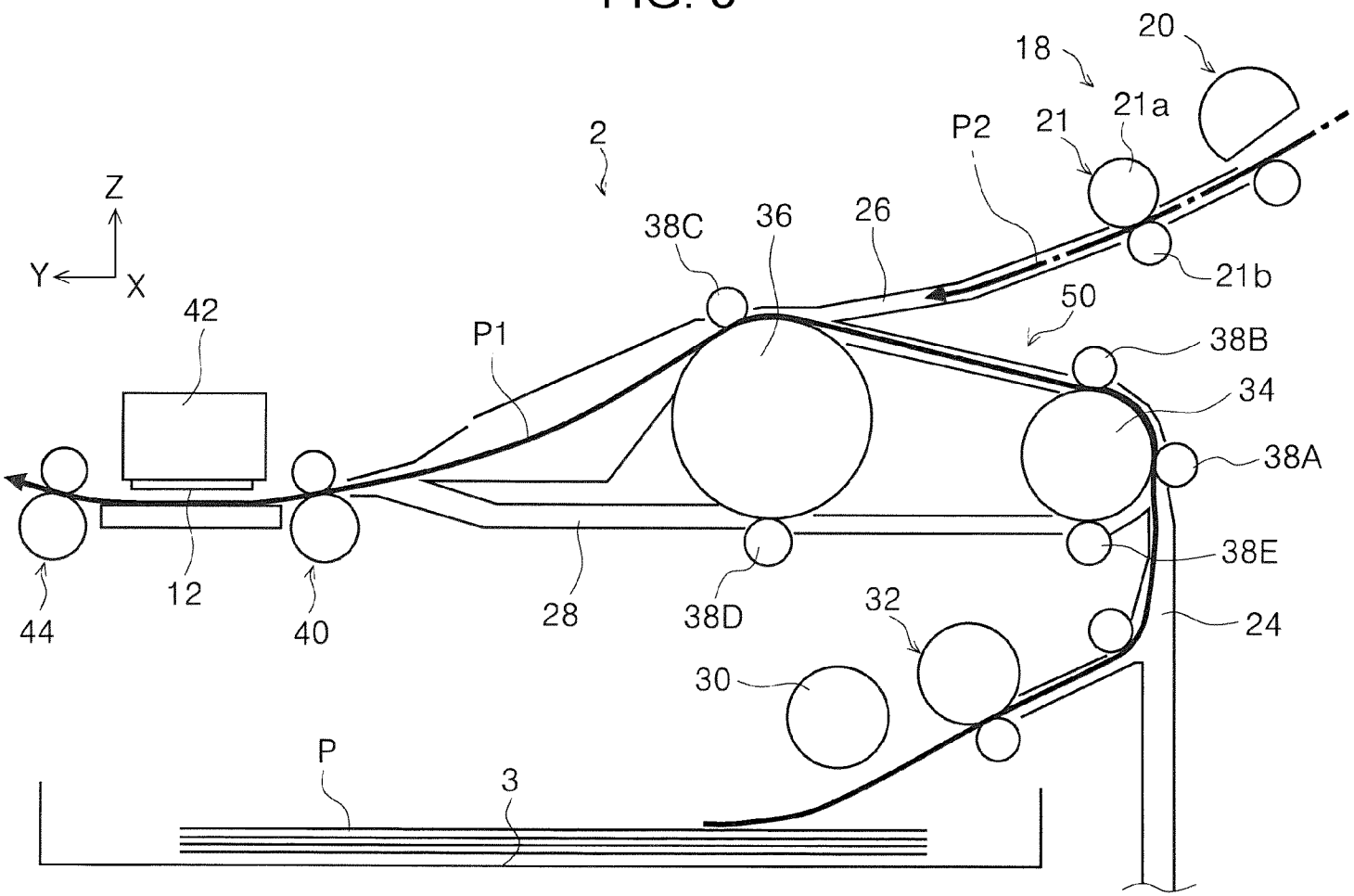
FIG. 3 is a simplified view of sheet transportation paths in the recording unit.

Next, with reference to FIGS. 2, 3, and 4, sheet transportation paths in the recording unit 2 configured to perform recording on paper, which is an example of a medium, will now be explained. The recording unit 2 includes a sheet feeding path 24 (FIG. 3), another sheet feeding path 26 (FIG. 3), which is an example of a second medium transportation path, and a reversal path 28 (FIG. 4), which is an example of a first medium transportation path.

The sheet feeding path 24 is a path for feeding a sheet from the sheet container cassette 3 to a reversing roller 34. A sheet is picked up from the sheet container cassette 3 and transported downstream along the sheet feeding path 24 by a pickup feed roller 30 and a pair of transportation rollers 32. The reference alphabet P denotes a stack of sheets of paper contained in the sheet container cassette 3. The reversing roller 34 is provided downstream of the pair of transportation rollers 32. A forwarding roller 36 is provided at a +Y-directional position with respect to the reversing roller 34, with a certain space therebetween. In the present embodiment, the diameter of the reversing roller 34 is smaller than the diameter of the forwarding roller 36. The reversing roller 34 and the forwarding roller 36 are components of a unit module 50 described later.

A first driven roller 38A, a second driven roller 38B, and a fifth driven roller 38E are provided around the reversing roller 34. The rollers 38A, 38B, and 38E are driven to rotate by rotation of the reversing roller 34. A third driven roller 38C and a fourth driven roller 38D are provided around the forwarding roller 36. The rollers 38C and 38D are driven to rotate by rotation of the forwarding roller 36. Among these driven rollers, the second driven roller 38B and the third driven roller 38C are components of the unit module 50 described later.

The sheet transported downstream in the transportation direction by the pair of transportation rollers 32 are nipped sequentially, first between the reversing roller 34 and the first driven roller 38A, next between the reversing roller 34 and the second driven roller 38B, and next between the forwarding roller 36 and the third driven roller 38C, to be transported downstream in the transportation direction.

Transportation rollers 40, which make up a pair, are provided downstream of the forwarding roller 36 in the transportation direction. A carriage 42 having the recording head 12 is provided downstream of the pair of transportation rollers 40. In the present embodiment, the carriage 42 is able to reciprocate in the X-axis direction. The recording head 12 is mounted on the bottom portion of the carriage 42. The recording head 12 ejects ink, which is an example of liquid, onto a sheet.

Ejection rollers 44A, which make up a pair, are provided downstream of the carriage 42 in the transportation direction. After completion of recording by the recording head 12, the pair of ejection rollers 44 ejects the recorded sheet onto the ejection tray 5. The bold line denoted by the reference numeral P1 in FIG. 3 depicts a sheet course along which a sheet is fed via the sheet feeding path 24, recorded, and then ejected.

Next, with reference to FIGS. 2, 3, and 4, the sheet feeding path 26 will now be explained. The sheet feeding path 26 is a path for feeding a sheet from a sheet feeding unit 18, which is provided at the rear portion of the apparatus, to the forwarding roller 36. As illustrated in FIG. 2, the sheet feeding unit 18 includes a supporting member 19, on which sheets can be placed in an inclined position, a pickup feed roller 20, which picks up and feeds a sheet from among the sheets supported by the supporting member 19, and a forwarding roller pair 21, which is provided downstream of the pickup feed roller 20. The forwarding roller pair 21 consists of a driving roller 21*a* (FIG. 3) and a driven roller 21*b* (FIG. 3). The driving roller 21*a* is driven by a motor that is not illustrated. The driving roller 21*a* is an example of a first roller. A sheet is nipped between the driving roller 21*a* and the driven roller 21*b*. The driven roller 21*b* is an example of a second roller.

In the present embodiment, the sheet feeding path 26 merges with the path leading from the reversing roller 34 to the forwarding roller 36 at the junction upstream of, in the transportation direction, the nip position between the forwarding roller 36 and the third driven roller 38C. The dot-and-dash line denoted by the reference numeral P2 in FIG. 3 depicts a sheet course along which a sheet is fed via the sheet feeding path 26, recorded, and then ejected.

Figure 4:
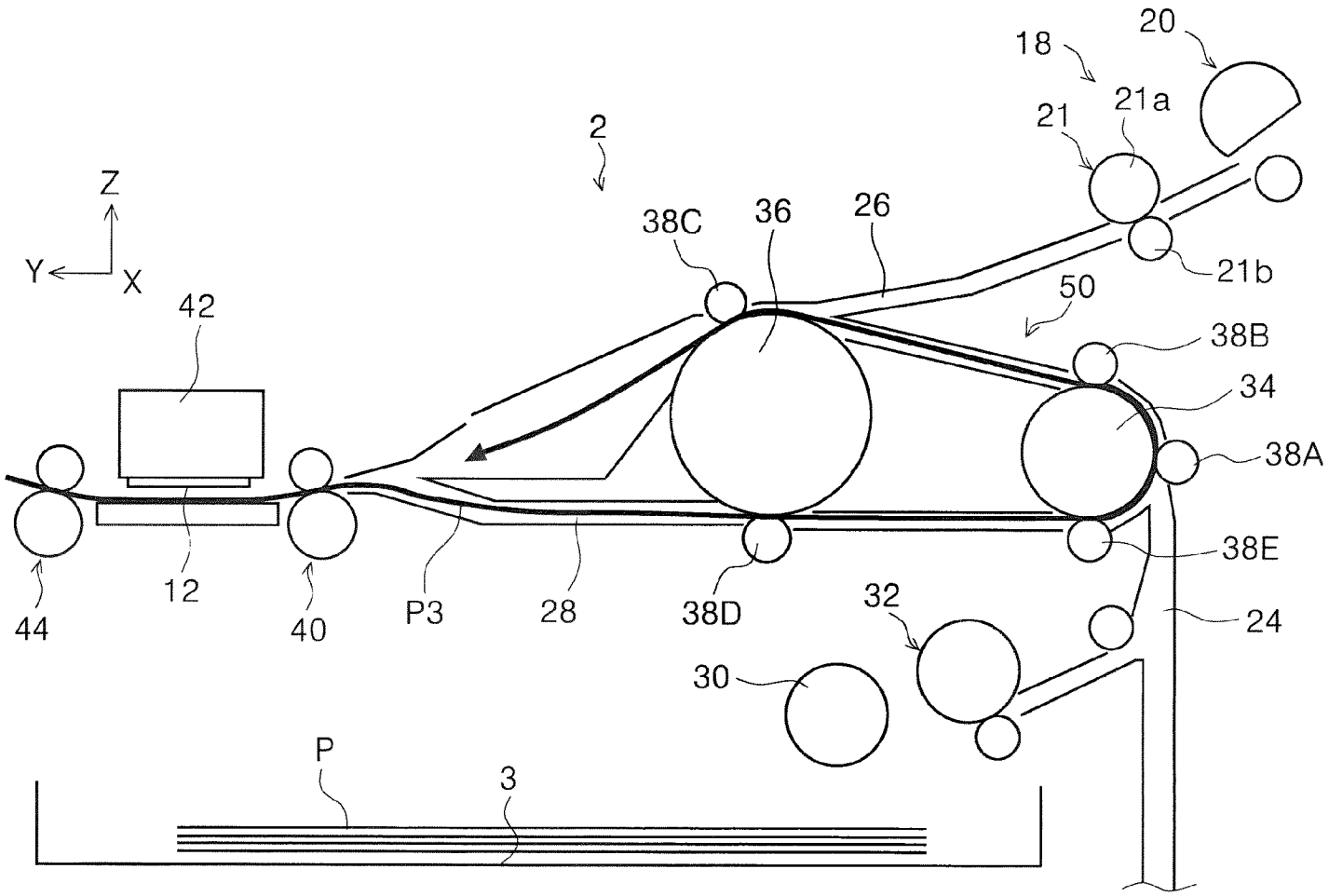
FIG. 4 is a simplified view of sheet transportation paths in the recording unit.

With reference to FIG. 4, the reversal path 28 will now be explained. In the present embodiment, the reversal path 28 is configured as a path for reversing a first surface (front) and a second surface (back) of a sheet with each other. Specifically, after completion of recording on a first surface of a sheet, the pair of transportation rollers 40 is rotated in the reverse direction to transport the sheet to the nip point between the forwarding roller 36 and the fourth driven roller 38D.

After passing through the nip point between the forwarding roller 36 and the fourth driven roller 38D, the sheet is transported around the reversing roller 34 downstream in the transportation direction while being nipped sequentially by the fifth driven roller 38E, the first driven roller 38A, and the second driven roller 38B in this order. By going around the reversing roller 34, the sheet is turned over for reversal of the first surface (front) and the second surface (back) with each other.

After passing through the nip of the second driven roller 38B, the sheet is nipped between the forwarding roller 36 and the third driven roller 38C, and is then transported to the pair of transportation rollers 40 again. The pair of transportation rollers 40 transports the sheet to an area facing the recording head 12, with the second surface of the sheet up. The recording head 12 ejects ink toward the second surface of the sheet, thereby performing recording thereon. After completion of recording on the second surface, the sheet is ejected by the pair of ejection rollers 44 toward the ejection tray 5. The solid line denoted by the reference numeral P3 in FIG. 3 depicts a sheet course along which a sheet to be turned over is transported along the reversal path 28.

Figure 5:
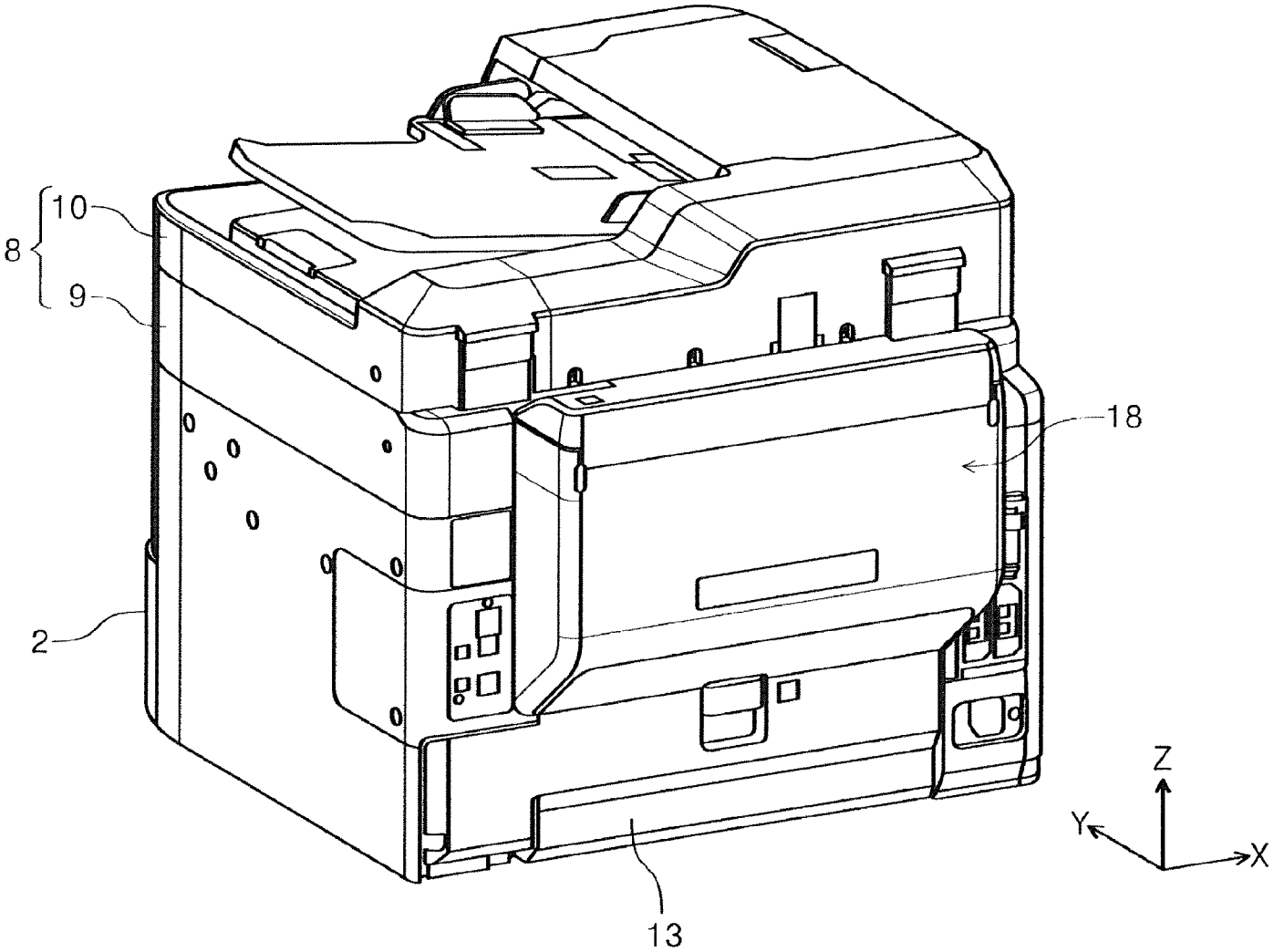
FIG. 5 is a rear perspective view of the multifunction peripheral, shown with a cover closed completely.
Figure 6:
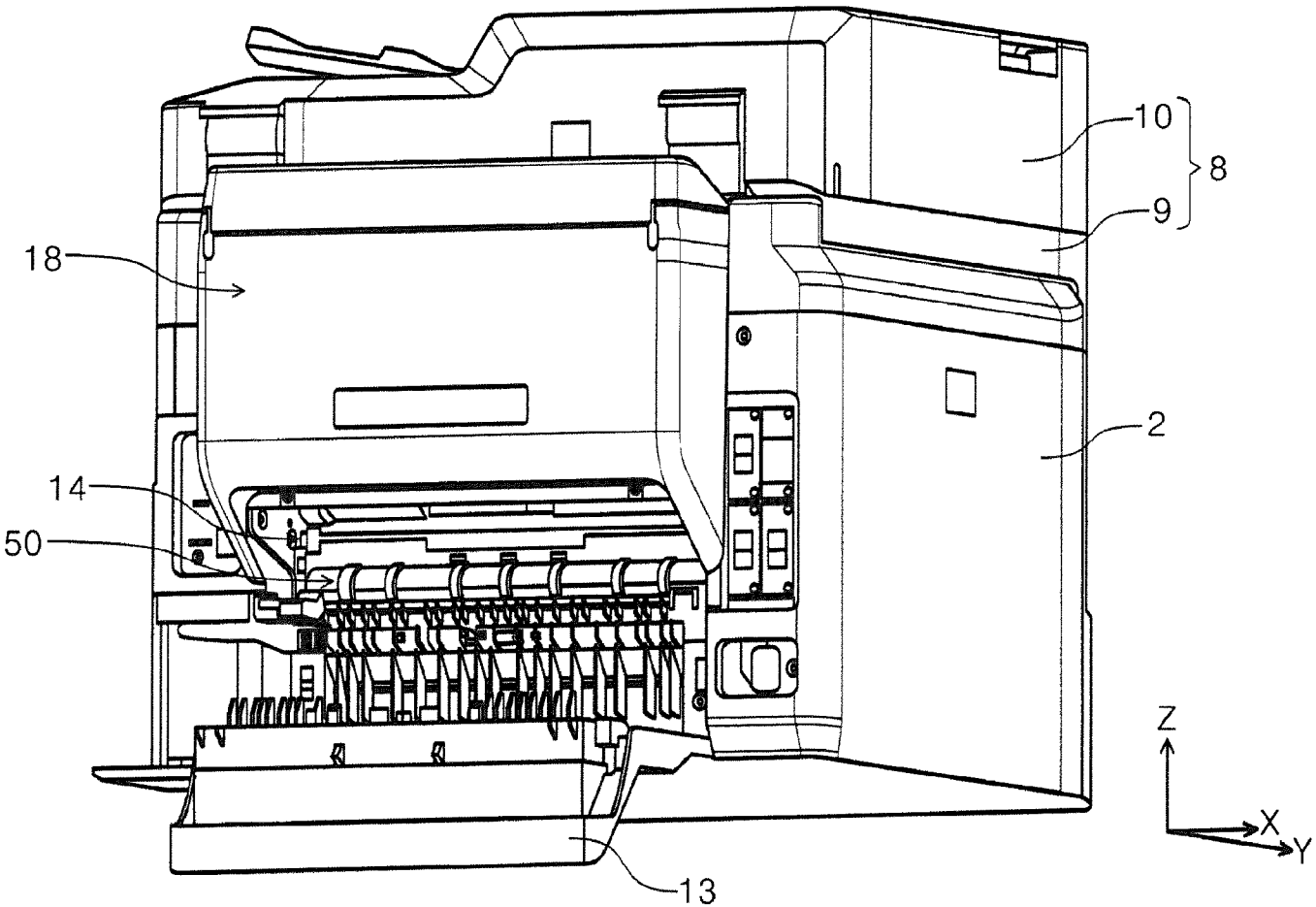
FIG. 6 is a rear perspective view of the multifunction peripheral, shown with the cover opened completely.
Figure 7:
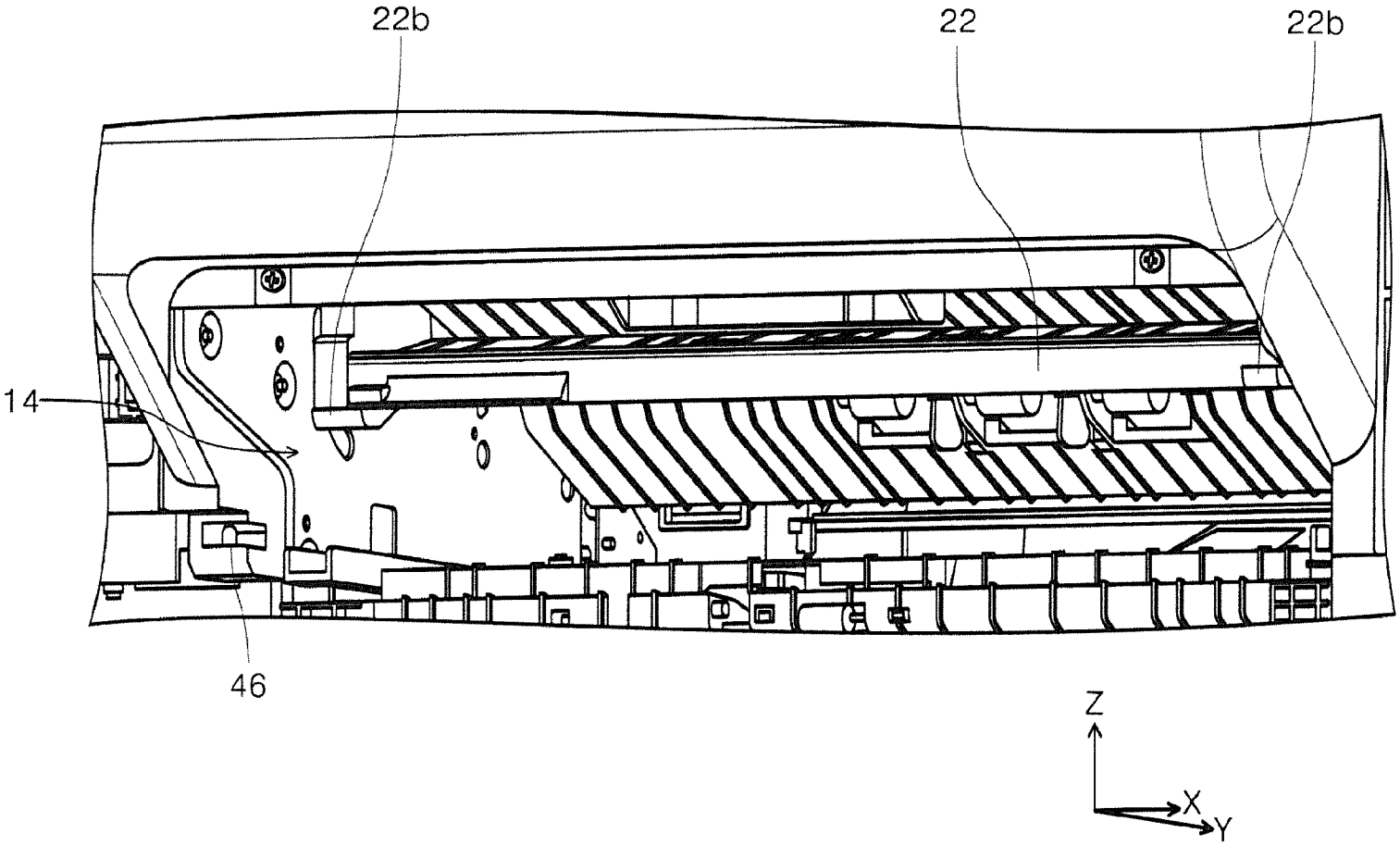
FIG. 7 is a perspective view of an attachment portion to which a unit module is to be attached, shown with a path forming member put in second position.
Figure 11:
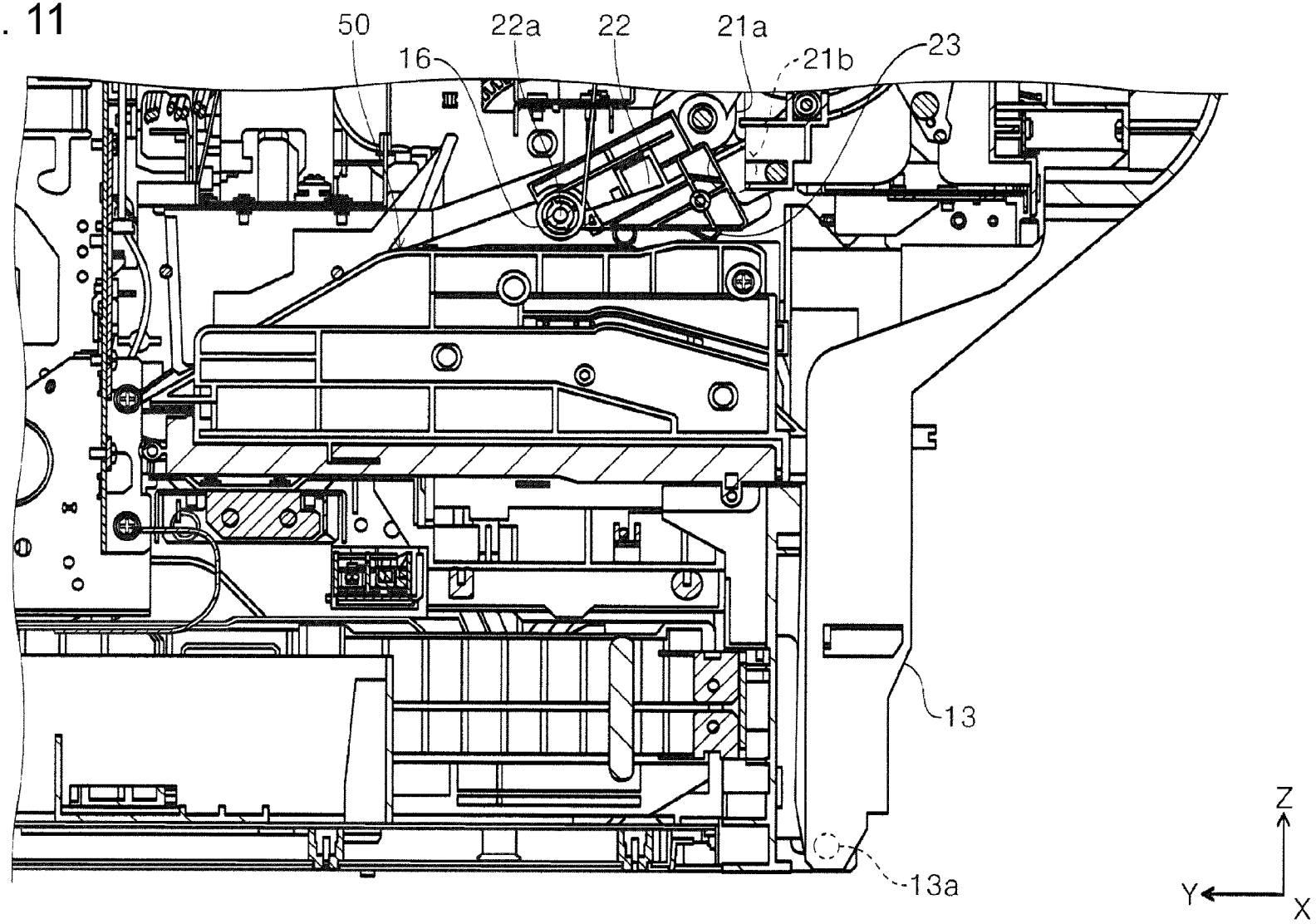
FIG. 11 is a partial sectional view of the recording unit, shown with the cover closed completely.
Figure 12:
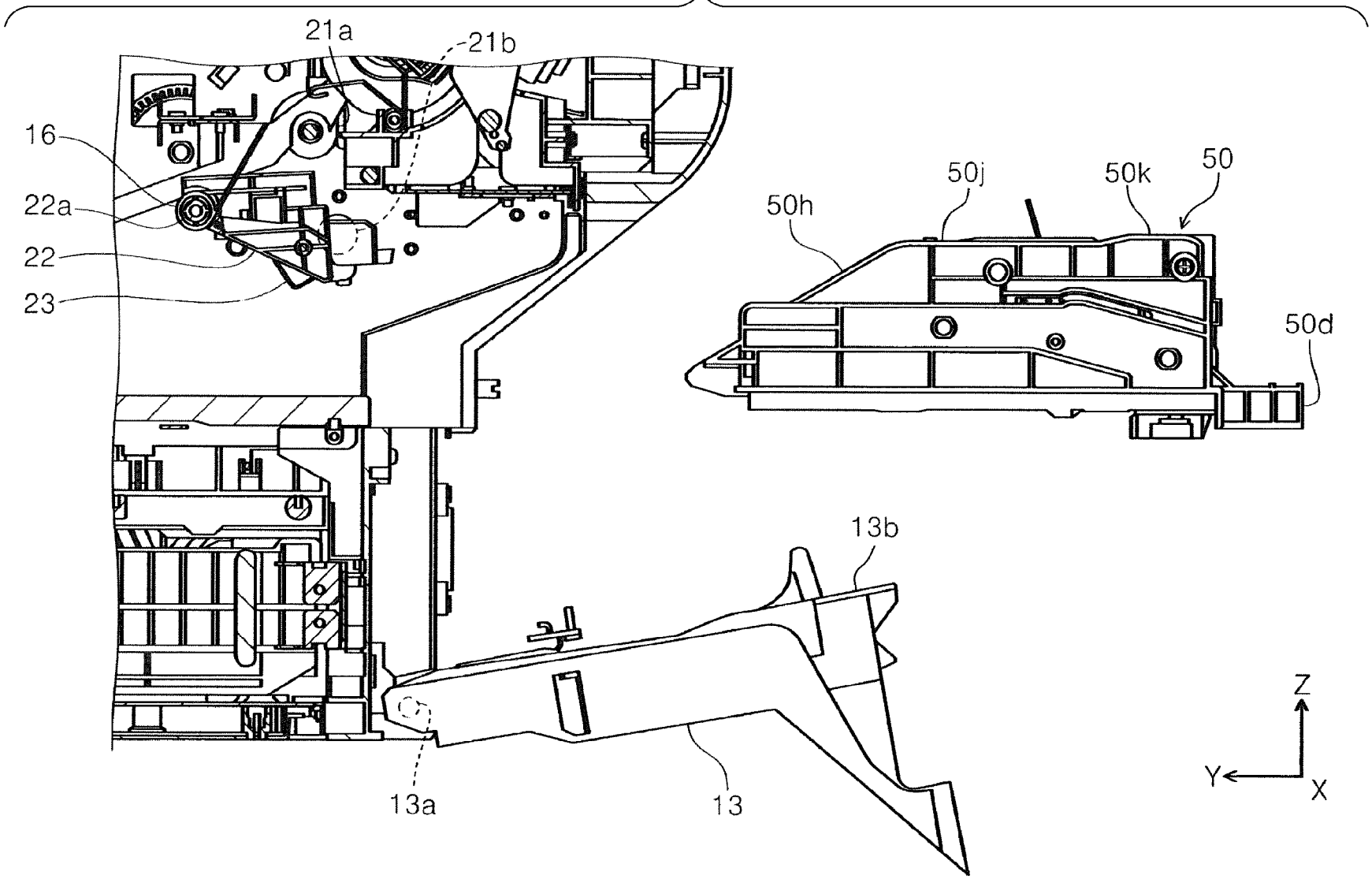
FIG. 12 is a partial sectional view of the recording unit, shown with the cover opened.

Next, with reference to FIG. 5 and subsequent drawings, a unit module 50 will now be explained. A cover 13 that can be opened and closed is provided on the rear of the recording unit 2. The cover 13 is an example of an opening-and-closing member. The cover 13 is pivotable around its pivot shaft 13*a* (FIGS. 11 and 12). The cover 13 can be kept in a closed state (FIG. 11) by a lock mechanism that is not illustrated. When the cover 13 is opened away from the recording unit 2, an attachment portion 14 inside the recording unit 2 becomes exposed as illustrated in FIGS. 6 and 7. Maintenance work for attachment or detachment of the unit module 50 can be done in this state. The attachment portion 14 may be referred as an opening for accommodation of the unit module 50, or a housing area or a housing space for accommodation of the unit module 50, in the recording unit 2.

In the present embodiment, the unit module 50 is a unitized assembly including the reversing roller 34, the forwarding roller 36, the second driven roller 38B, and the third driven roller 38C. By being attached to the attachment portion 14 of the recording unit 2, the unit module 50 forms the reversal path 28, which is an example of the first medium transportation path. Detaching the unit module 50 from the attachment portion 14 opens the reversal path 28. When a sheet jam has occurred on the reversal path 28, the detachment therefore makes it possible to troubleshoot the jam. In the present embodiment, each of the reversing roller 34 and the forwarding roller 36 is made up of a plurality of roller segments arranged at intervals in the X-axis direction.

Figure 9:
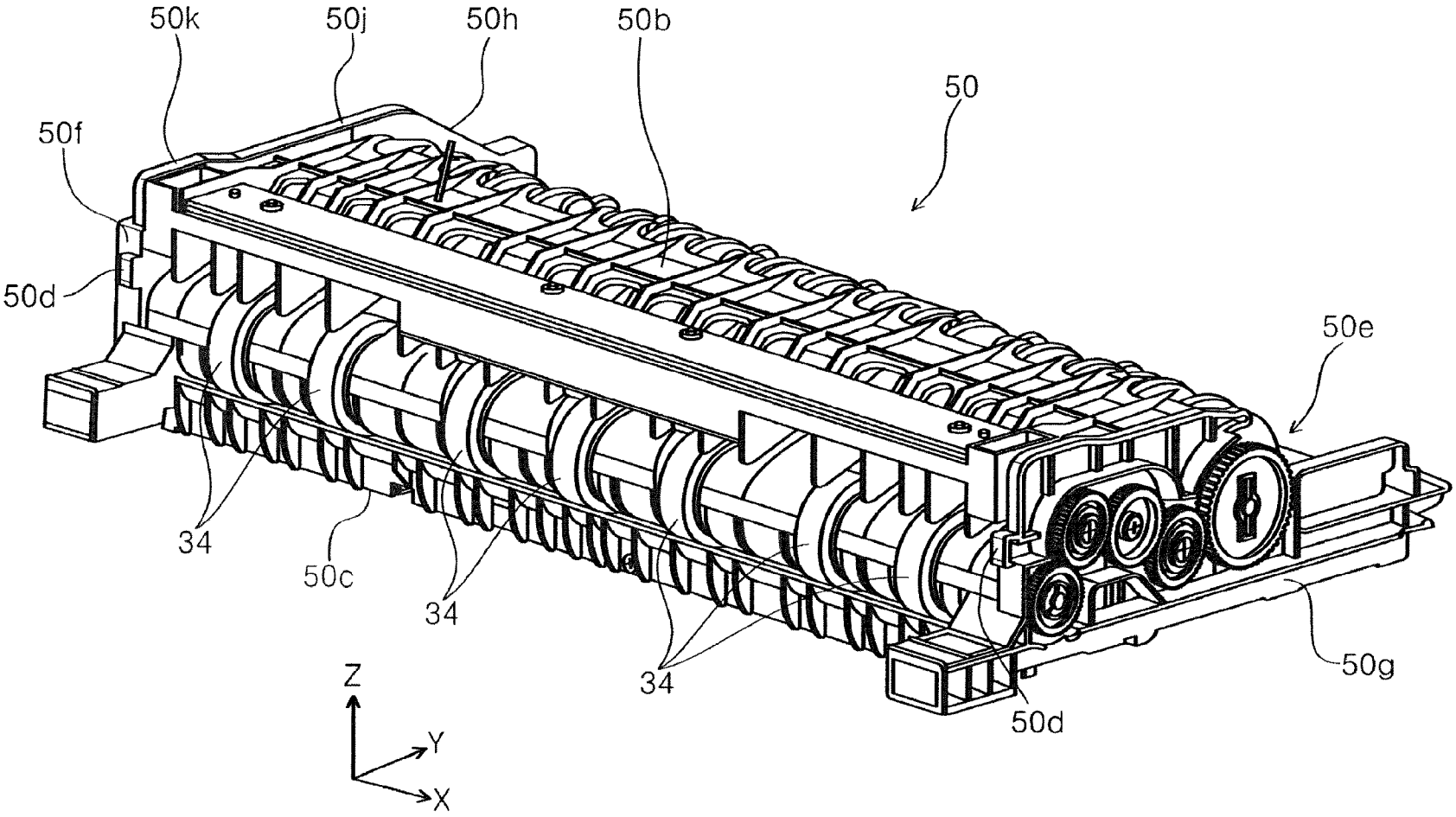
FIG. 9 is a rear perspective view of the unit module.
Figure 10:
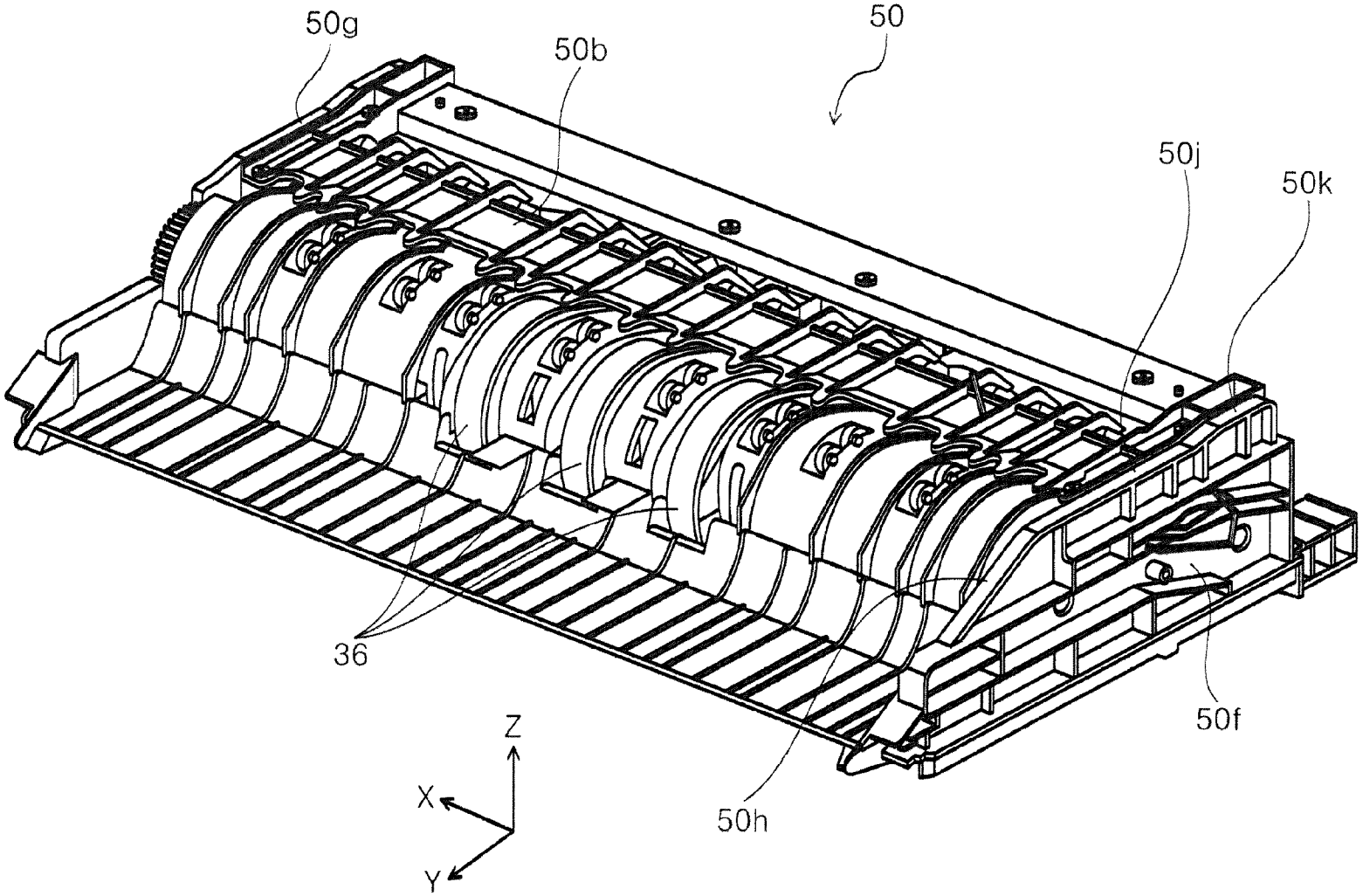
FIG. 10 is a front perspective view of the unit module.

As illustrated in FIGS. 9 and 10, the unit module 50 includes an upper path forming member 50*b*, a lower path forming member 50*c*, and side frames 50*f* and 50*g*. A driving force transmitter 50*e* is mounted on the side frame 50*g*. When the unit module 50 is attached to the attachment portion 14, a driving force is transmitted from a motor (not illustrated) of the recording unit 2 to the reversing roller 34 and the forwarding roller 36 via the driving force transmitter 50*e*.

The side frame 50*f* has a sloped surface 50*h*, which is an example of a pushing-up portion, a level surface 50*j*, and a keeping surface 50*k*. These surfaces of the side frame 50*f* will be explained later.

Each of the side frames 50*f* and 50*g* has a contact portion 50*d* protruding from its −Y-directional portion. When the cover 13 is closed after the attachment of the unit module 50 to the attachment portion 14, the contact portion 50*d* is pushed by a positioning portion 13*b* (see FIG. 12) of the cover 13 to put the unit module 50 into an attachment position properly.

Figure 8:
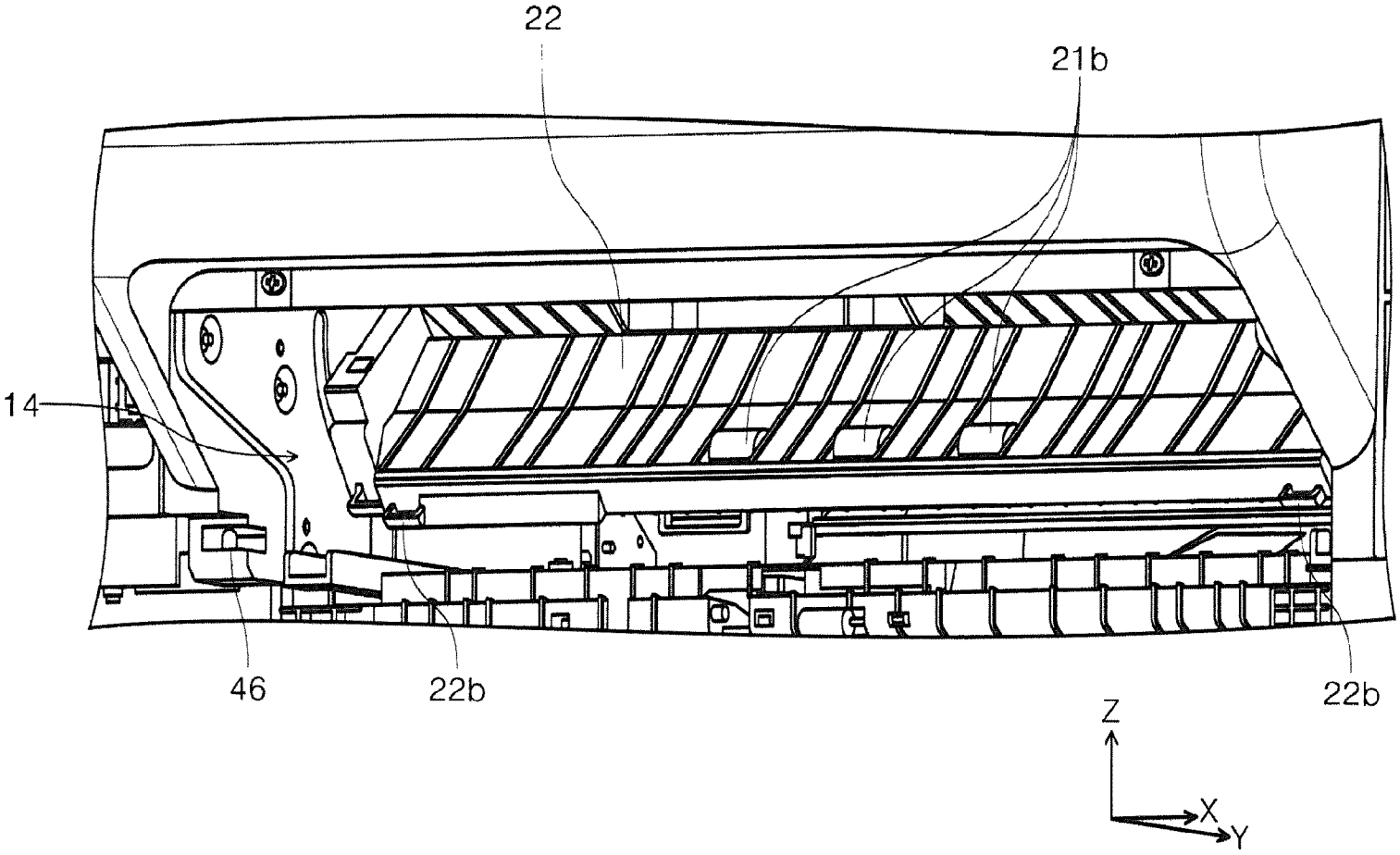
FIG. 8 is a perspective view of the attachment portion to which the unit module is to be attached, shown with the path forming member put in third position.

Next, a path forming member 22 provided on the attachment portion 14, to which the unit module 50 is attached, will now be explained. The path forming member 22 is provided on the attachment portion 14. The path forming member 22 extends in the X direction as illustrated in FIGS. 7 and 8. The path forming member 22 is pivotable around its pivot shaft 22*a* illustrated in FIGS. 11, 12, and 13 on a Y-Z plane, that is, able to change in positional state.

A coil spring 16 is provided on the pivot shaft 22*a*. The coil spring 16 applies an upward force to the path forming member 22. That is, the coil spring 16 applies a force for counterclockwise pivotal movement to the path forming member 22 in FIGS. 11, 12, and 13. However, the urging force of the coil spring 16 is set to balance with the weight of the path forming member 22. Therefore, the path forming member 22 is kept in a positional state illustrated in FIG. 12 (second position) when no force except for the urging force of the coil spring 16 acts on the path forming member 22.

The driven roller 21*b* provided on the sheet feeding path 26 (FIGS. 3 and 4) is rotatably supported by the path forming member 22. Pivotal movement of the path forming member 22 brings the driven roller 21*b* toward or away from its counterpart, that is, the driving roller 21*a*. When the path forming member 22 is in a position of holding the driven roller 21*b* in contact with the driving roller 21*a* (first position), the path forming member 22 forms a part of the sheet feeding path 26.

The path forming member 22 is able to be coupled to the unit module 50. Specifically, when the unit module 50 is detached, the path forming member 22 retracts from the sheet feeding path 26 (FIGS. 3 and 4) and advances into the attachment area of the unit module 50 as can be seen from a positional change from FIG. 11 to FIG. 12. In the following description, the position of the path forming member 22 is defined as first position when the path forming member 22 forms the sheet feeding path 26, with the unit module 50 attached. The position of the path forming member 22 is defined as second position when the path forming member 22 has advanced into the attachment area of the unit module 50 due to detachment of the unit module 50.

Figure 13:
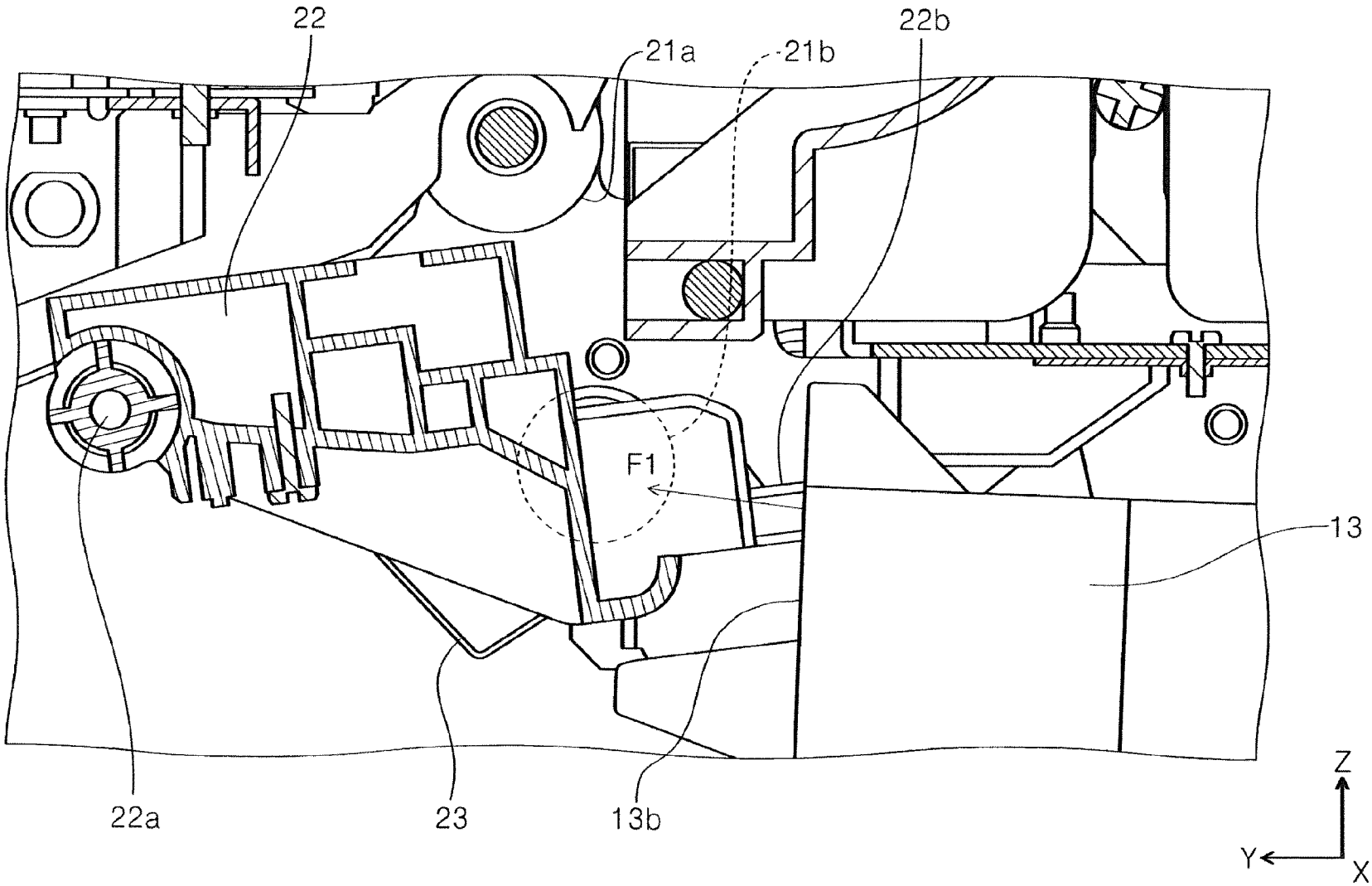
FIG. 13 is a partial sectional view of the recording unit, shown with the cover in contact with the path forming member.

The path forming member 22 advances onto the opening-and-closing trajectory of the cover 13 when put into the second position. As illustrated in FIG. 13, the path forming member 22 has pushing-force receivers 22*b* on its −Y-directional face. When the path forming member 22 is in the second position, the cover 13, even if attempted to be closed, knocks against the pushing-force receivers 22*b*. Therefore, the cover 13 cannot be closed completely in this positional state.

In other words, when the unit module 50 is not attached, the path forming member 22 is on the opening-and-closing trajectory of the cover 13 to prevent the cover 13 from being closed completely. As illustrated in FIGS. 7 and 8, a sensor 46, which detects the complete closing of the cover 13, is provided on the recording unit 2. The cover 13 has a non-illustrated protrusion configured to mechanically go into the sensor 46. A controller (not illustrated) of the recording unit 2 is able to detect the complete closing of the cover 13 by sensing the protrusion. The controller (not illustrated) of the recording unit 2 does not allow recording operation and sheet transportation operation to be performed when the cover 13 is not closed completely.

In the present embodiment, as explained above, the path forming member 22 configured to form the sheet feeding path 26 (FIGS. 3 and 4) is utilized for preventing the cover 13 from being closed completely when the apparatus is in a state of detachment of the unit module 50. This structure reduces the number of parts required for preventing the cover 13 from being closed completely and therefore prevents an increase in the cost of the apparatus.

Switching in the positional state of the path forming member 22 is further explained below. The path forming member 22 that is in the second position (FIG. 12) is pushed up by the unit module 50 when the unit module 50 is attached to the attachment portion 14. This causes switching to the first position (FIG. 11) from the second position. The path forming member 22 that is in the first position loses positional support by the unit module 50 when the unit module 50 is detached from the attachment portion 14. This causes switching to the second position from the first position. Since the positional state of the path forming member 22 switches due to attachment and detachment of the unit module 50, the structure of the positional switcher of the path forming member 22 is simplified, thereby reducing cost.

Figure 14:
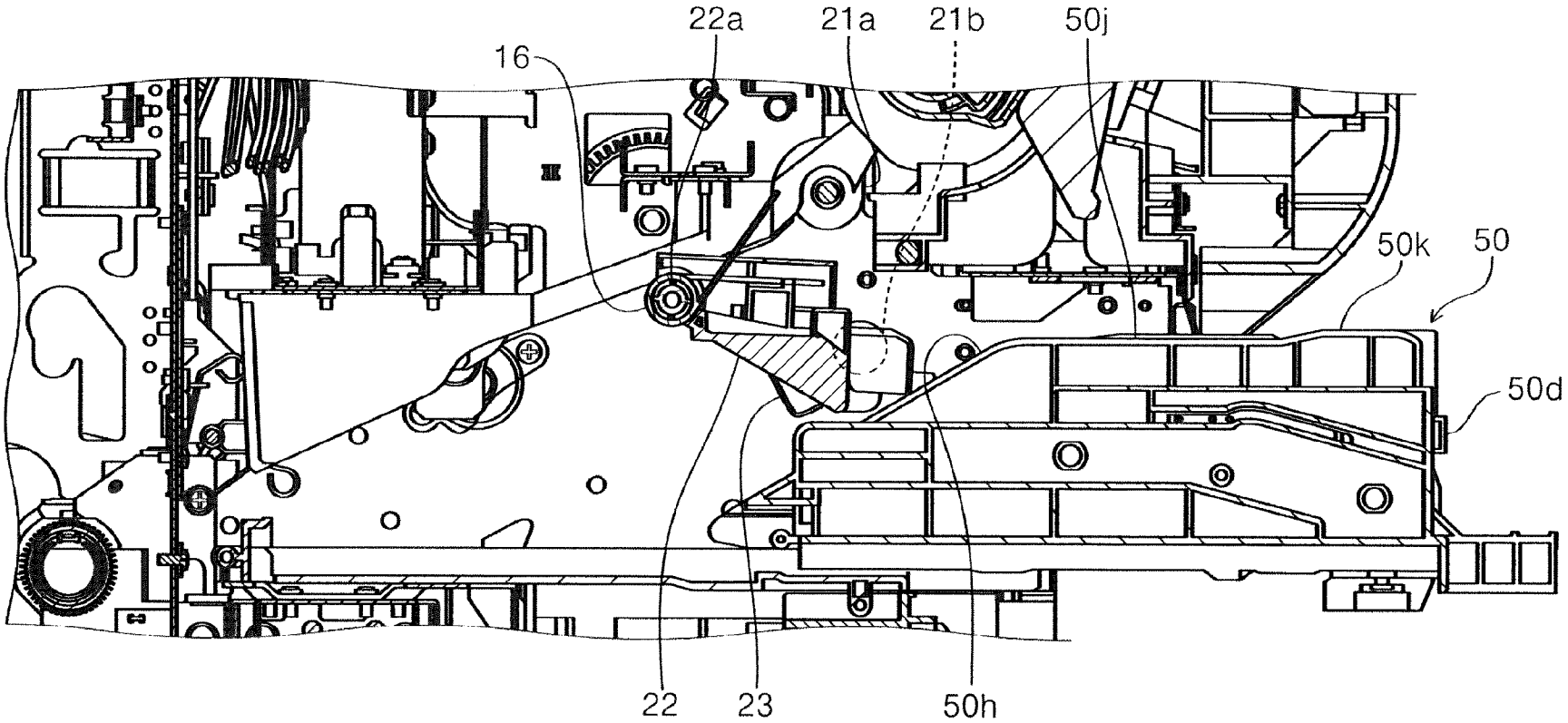
FIG. 14 is a partial sectional view of the recording unit, showing a process of attachment of the unit module.
Figure 15:
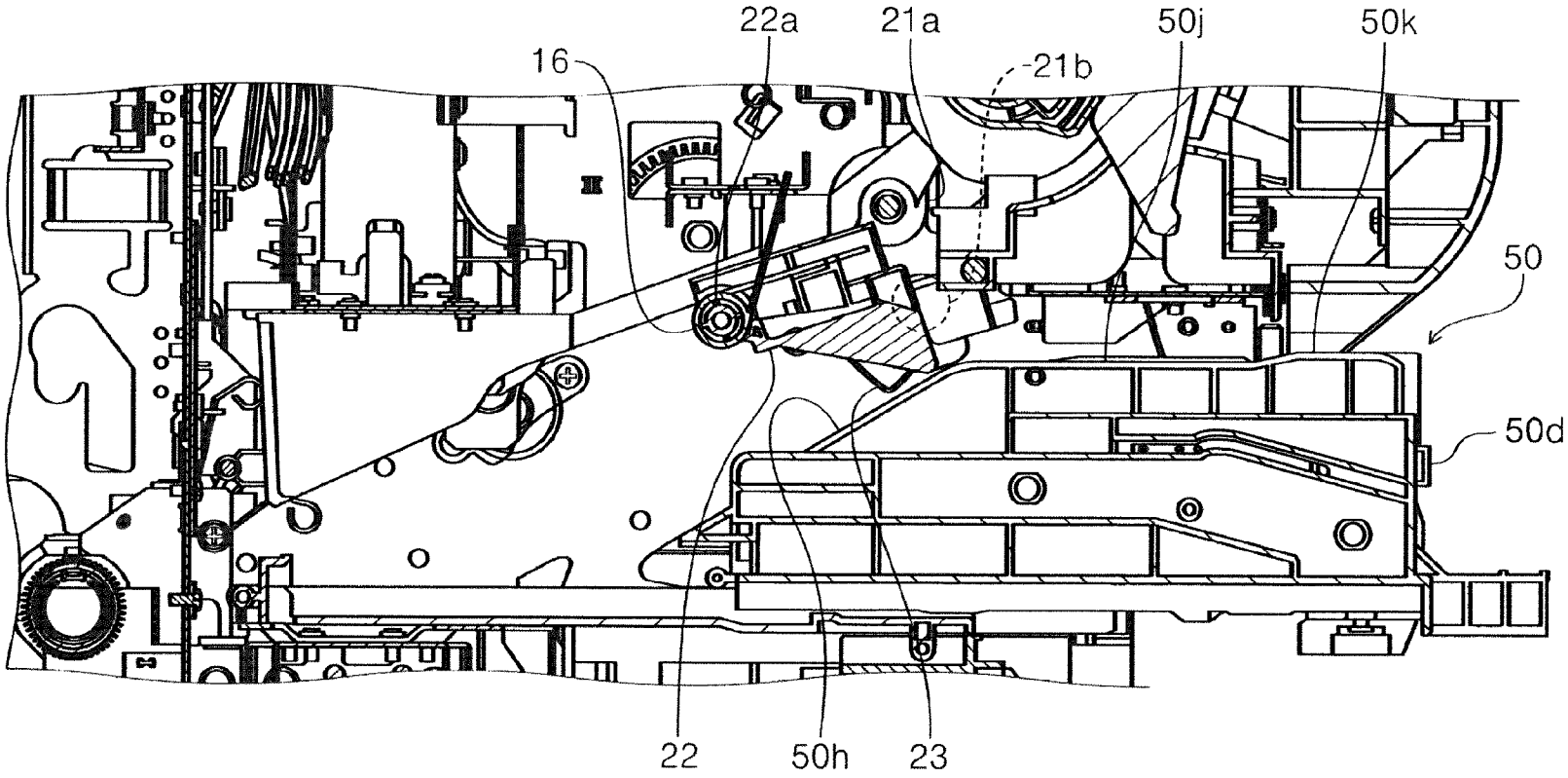
FIG. 15 is a partial sectional view of the recording unit, showing a process of attachment of the unit module.
Figure 16:
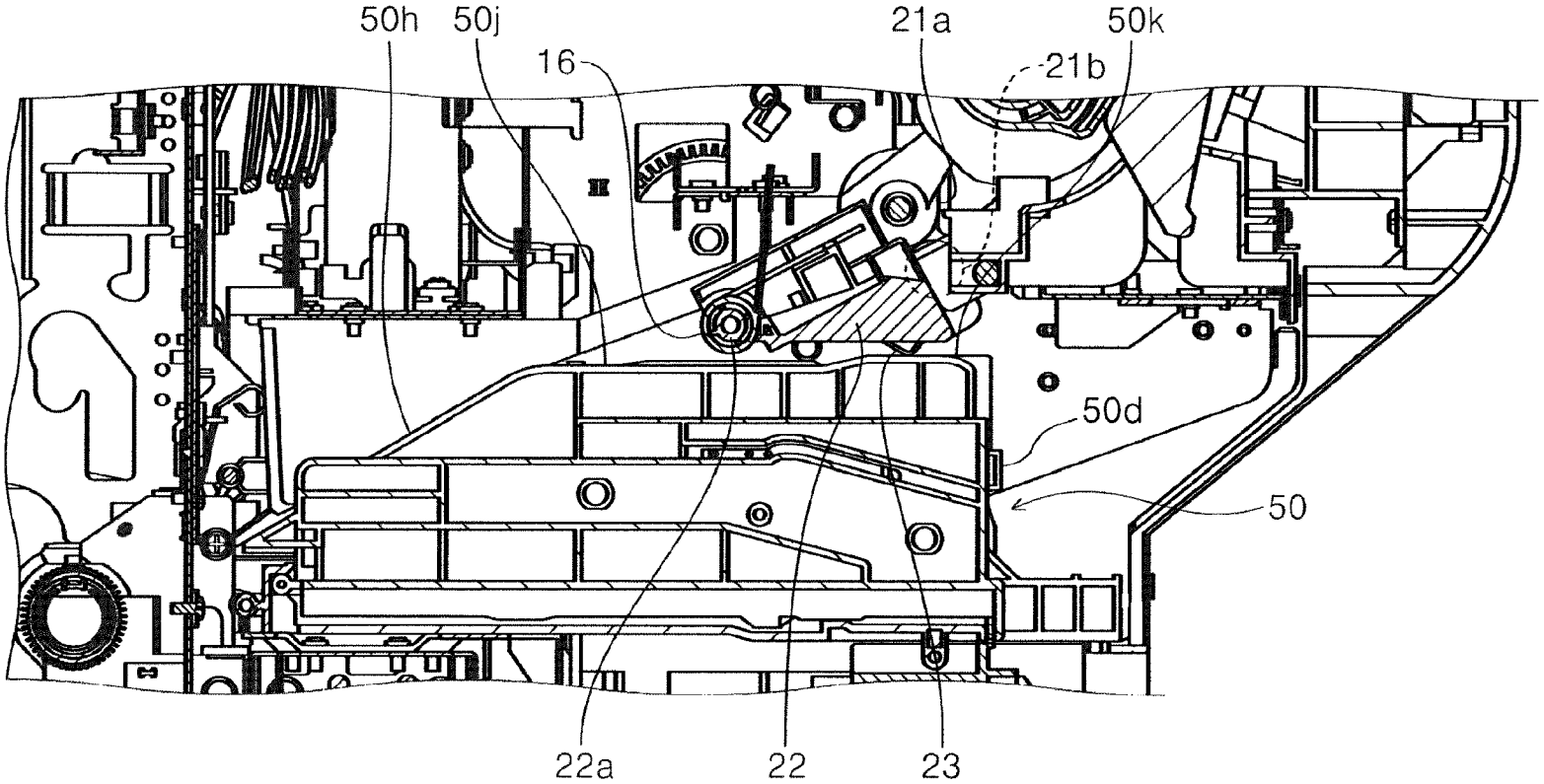
FIG. 16 is a partial sectional view of the recording unit, shown with the unit module after completion of attachment.

More specifically, as illustrated in FIGS. 14, 15, and 16, the unit module 50 has a sloped surface 50*h*, which is an example of a pushing-up portion, for pushing up the path forming member 22. An amount of pushing up the path forming member 22 increases in the process of attachment of the unit module 50, as can be seen from a change from FIG. 14 to FIG. 15. Therefore, a sense of resistance that a user will feel during the attachment of the unit module 50 is minimized.

The path forming member 22 is kept in the first position by being supported by the unit module 50 as illustrated in FIG. 16. This makes it possible to keep the path forming member 22 in the first position reliably. The path forming member 22 includes a leaf spring 23, which is an example of an elastic member, at a position facing the unit module 50. The path forming member 22 is pushed in a direction of being held in the first position due to an elastic force of the leaf spring 23 acting between the unit module 50 and the path forming member 22 in the first position. This further ensures that the path forming member 22 is kept in the first position. Moreover, a sheet is nipped securely between the driven roller 21*b* and the driving roller 21*a*. As mentioned above, the leaf spring 23 is just an example of an elastic member. The elastic member is not limited to a leaf spring. Any member that exerts an elastic force, for example, a coil spring or rubber, may be used instead. However, if such an alternative elastic member is used, it is advantageous to choose a member that has a small friction resistance with the unit module 50 when it is provided at a position facing the unit module 50 in the process of attachment of the unit module 50, similarly to the leaf spring 23 according to the present embodiment.

In the process of attachment of the unit module 50, first, the sloped surface 50*h* of the unit module 50 pushes up the path forming member 22 as illustrated in FIGS. 14 and 15. Next, the level surface 50*j* of the unit module 50 comes into contact with the leaf spring 23. Finally, the keeping surface 50*k* of the unit module 50 supports the path forming member 22 from below, with the leaf spring 23 therebetween.

In the present embodiment, the path forming member 22 is able to change from the second position (FIGS. 7 and 12) to third position (FIG. 8), which is further away from the sheet feeding path 26. That is, the pivotable range of the path forming member 22 is expanded clockwise from the second position illustrated in FIG. 12. A user is able to push the path forming member 22 further downward from the second position (FIGS. 7 and 12). Doing so will open the sheet feeding path 26 more widely. When a sheet jam has occurred on the sheet feeding path 26, this makes it easier to troubleshoot the jam.

In addition, as explained earlier, the path forming member 22 supports the driven roller 21*b*, and it is possible to nip a sheet between the driving roller 21*a* and the driven roller 21*b* when the path forming member 22 is in the first position (FIG. 11). Since the driven roller 21*b* is separated away from the driving roller 21*a* when the path forming member 22 switches from the first position (FIG. 11) to the second position (FIG. 12), the nipping of the sheet between the driving roller 21*a* and the driven roller 21*b* is released, making it easier to troubleshoot a sheet jam that has occurred on the sheet feeding path 26.

As described earlier, the path forming member 22 changes in positional state by pivoting around its pivot shaft 22*a*. When the path forming member 22 that is in a state of advancing onto the opening-and-closing trajectory of the cover 13, namely, in a state of the second position, receives a pushing force from the cover 13 attempted to be closed, the pushing force, which the path forming member 22 receives at its region of contact with the cover 13, is designed to act toward the pivot shaft 22*a*. In FIG. 13, the arrow F1 depicts a pushing force which the path forming member 22 having advanced onto the opening-and-closing trajectory of the cover 13 receives from the cover 13 attempted to be closed. The magnitude of the pushing force F1 depends on how softly a user pushes the cover 13. Regardless of the magnitude, however, the direction in which the pushing force F1 acts is a direction toward the pivot shaft 22*a*. In FIG. 13, the reference numeral 22*b* of the path forming member 22 denotes pushing-force receivers that receive the pushing force F1 from the cover 13. The position of the path forming member 22 in FIG. 13 is a position pivoted counterclockwise slightly from the second position illustrated in FIG. 12.

Since the pushing force F1 acts toward the pivot shaft 22*a*, the path forming member 22 does not change in positional state from the second position to the first position due to the pushing force received from the cover 13 attempted to be closed. Since such unwanted positional switching does not occur, it is possible to avoid a problem of closing of the cover 13 from occurring when the unit module 50 is not attached.

In the present embodiment, the pushing-force receivers 22*b*, which define regions where the cover 13 comes into contact when it is closed onto the path forming member 22 that is in the second position, are provided respectively near two X-directional ends of the path forming member 22 in the width direction (X-axis direction) intersecting with the direction of attachment and detachment of the unit module 50 (Y-axis direction), as illustrated in FIG. 7.

As described earlier, the sensor 46 (FIG. 7) configured to detect the complete closing of the cover 13 is provided on the recording unit 2. Suppose that the pushing-force receiver 22*b* is provided near one end only of the path forming member 22 in the X-axis direction. In such a hypothetical structure, there is a risk that the side where the pushing-force receiver 22*b* is not provided might become closed due to deformation of the cover 13 when the cover 13 knocks against the pushing-force receiver 22*b*. That is, there is a risk of incomplete closing. If the sensor 46 is provided on the side where the pushing-force receiver 22*b* is not provided, the controller of the apparatus (not illustrated) might erroneously determine that the cover 13 has been closed completely, resulting in granting a wrong permission for recording operation. Therefore, when the pushing-force receiver 22*b* is provided near one end only of the path forming member 22 in the X-axis direction, it is advantageous to provide the sensor 46 on the same side as that of the pushing-force receiver 22*b*. Adopting such a structure makes it possible to avoid the above problem.

The scope of the present disclosure is not limited to the foregoing embodiments. The present disclosure can be modified in various ways within the scope of the recitation of appended claims. Needless to say, such modifications are within the scope of the present disclosure.

What is claimed is:

1. A recording apparatus, comprising:

an apparatus body that includes a recorder that performs recording on a medium;

an opening-and-closing member that is able to be opened away from and closed toward the apparatus body;

an attachment portion that is provided in the apparatus body and becomes exposed by opening the opening-and-closing member;

a unit module that is detachably attached to the attachment portion and constitutes a part of a first medium transportation path when attached to the attachment portion;

a second medium transportation path that is provided above the first medium transportation path; and a path forming member that is located above the attachment portion and forms a part of the second medium transportation path; wherein the path forming member is able to change in positional state, the path forming member forms a part of the second medium transportation path and is put in a first position of being retracted from an opening-and-closing trajectory of the opening-and-closing member when the unit module is attached to the attachment portion, and the path forming member is put in a second position of being retracted from the second medium transportation path and advancing onto the opening-and-closing trajectory of the opening-and-closing member when the unit module is detached from the attachment portion.

2. The recording apparatus according to claim 1, wherein the path forming member that is in the second position is switched to the first position from the second position by being pushed up by the unit module when the unit module is attached to the attachment portion, and the path forming member that is in the first position is switched to the second position from the first position by losing positional support by the unit module when the unit module is detached from the attachment portion.

3. The recording apparatus according to claim 2, wherein the unit module includes a pushing-up portion for pushing up the path forming member, and the pushing-up portion has a sloped surface, and an amount of pushing up the path forming member increases as the unit module is moved in an attachment direction.

4. The recording apparatus according to claim 2, wherein the path forming member is kept in the first position by being supported by the unit module attached to the attachment portion.

5. The recording apparatus according to claim 4, wherein the path forming member includes an elastic member at a position facing the unit module, and the path forming member is pushed in a direction of being held in the first position due to an elastic force of the elastic member acting between the unit module and the path forming member in the first position.

6. The recording apparatus according to claim 1, wherein the path forming member is able to change from the second position to third position that is further away from the second medium transportation path.

7. The recording apparatus according to claim 1, wherein the second medium transportation path includes a first roller that transports the medium and a second roller that nips the medium with the first roller therebetween, the path forming member supports the second roller, the first roller and the second roller are able to nip the medium therebetween when the path forming member is in the first position, and the second roller is separated away from the first roller by positional switching of the path forming member from the first position to the second position.

8. The recording apparatus according to claim 1, wherein the path forming member changes in positional state by pivoting around a pivot shaft, and, when the path forming member that is in a state of advancing onto the opening-and-closing trajectory of the opening-and-closing member receives a pushing force from the opening-and-closing member attempted to be closed, the pushing force, which the path forming member receives at its region of contact with the opening-and-closing member, acts toward the pivot shaft.

9. The recording apparatus according to claim 1, wherein the apparatus body includes a sensor that detects complete closing of the opening-and-closing member, and a region where the opening-and-closing member comes into contact when the opening-and-closing member is closed onto the path forming member that is in the second position is on a same side as the sensor in a width direction intersecting with a direction of attachment and detachment of the unit module.

* * * * *